US010307898B2

(12) United States Patent
Lin

(10) Patent No.: US 10,307,898 B2
(45) Date of Patent: Jun. 4, 2019

(54) OBLIQUE FASTENING APPARATUS

(71) Applicant: KWANTEX RESEARCH INC., Tainan (TW)

(72) Inventor: Chao-Wei Lin, Tainan (TW)

(73) Assignee: KWANTEX RESEARCH INC., Tainan (TW)

( * ) Notice: Subject to any disclaimer, the term of this patent is extended or adjusted under 35 U.S.C. 154(b) by 694 days.

(21) Appl. No.: 14/883,096

(22) Filed: Oct. 14, 2015

(65) Prior Publication Data

US 2016/0256988 A1 Sep. 8, 2016

(30) Foreign Application Priority Data

Mar. 6, 2015 (TW) ..... 104107260 A

(51) Int. Cl.

| | |
|---|---|
| ***B25B 5/00*** | (2006.01) |
| ***B25B 5/02*** | (2006.01) |
| ***B25B 5/16*** | (2006.01) |
| ***B25C 3/00*** | (2006.01) |
| ***B25B 23/08*** | (2006.01) |

(52) U.S. Cl.

CPC ..... *B25B 23/08* (2013.01); *B25B 5/003* (2013.01); *B25B 5/02* (2013.01); *B25B 5/163* (2013.01); *B25C 3/006* (2013.01)

(58) Field of Classification Search

CPC . B23B 2247/10; B23B 2247/12; B23B 47/28; B23B 47/287; B25B 21/00; B25B 23/005; B25B 23/08; E04F 21/22

See application file for complete search history.

(56) References Cited

U.S. PATENT DOCUMENTS

| | | | | |
|---|---|---|---|---|
| 4,421,442 | A * | 12/1983 | Lindblad | B23B 47/288 408/108 |
| 5,299,896 | A * | 4/1994 | Ferri | B23B 47/281 408/103 |
| 5,551,795 | A * | 9/1996 | Engibarov | B23Q 1/28 403/381 |
| 5,740,705 | A | 4/1998 | Graham | |
| 6,394,713 | B1 * | 5/2002 | Yates, Sr. | B23B 47/288 408/115 R |
| 6,843,402 | B2 | 1/2005 | Sims et al. | |

(Continued)

FOREIGN PATENT DOCUMENTS

| | | |
|---|---|---|
| EP | 2 517 834 A2 | 10/2012 |
| TW | M294412 U | 7/2006 |

(Continued)

*Primary Examiner* — Tyrone V Hall, Jr.

(74) *Attorney, Agent, or Firm* — Muncy, Geissler, Olds & Lowe, P.C.

(57) ABSTRACT

An oblique fastening apparatus includes first and second clamping units. The first clamping unit includes a first main body, a first guide member, a first clamping member, and a first oblique fastener passage extending through the first guide member and the first clamping member and having a first discharge section communicating with ambient atmosphere. The second clamping unit includes a second main body movable relative to the first main body, and a second clamping member. The first and second clamping members are configured to clamp a workpiece therebetween. A guide unit is provided to guide relative movement of the first and second main bodies.

14 Claims, 15 Drawing Sheets

(56) References Cited

U.S. PATENT DOCUMENTS

| | | | | |
|---|---|---|---|---|
| 7,044,460 | B2 * | 5/2006 | Bolton | B25B 23/00 269/37 |
| 7,670,089 | B2 | 3/2010 | Chiang | |
| 8,171,835 | B2 | 5/2012 | Otsuka | |
| 8,480,343 | B2 | 7/2013 | Vandenberg | |
| 8,672,204 | B2 | 3/2014 | Vandenberg | |
| 8,747,043 | B2 | 6/2014 | Vandenberg | |
| 8,925,644 | B2 | 1/2015 | Vandenberg | |
| 8,955,210 | B2 | 2/2015 | Vandenberg | |
| 2002/0074705 | A1 * | 6/2002 | Marusiak | B23B 47/287 269/156 |
| 2010/0083610 | A1 * | 4/2010 | King | B25B 15/001 52/749.1 |

FOREIGN PATENT DOCUMENTS

| | | | |
|---|---|---|---|
| TW | M345665 | U | 12/2008 |
| TW | M392061 | U1 | 11/2010 |
| TW | M424202 | U | 3/2012 |
| TW | M435326 | U | 8/2012 |

* cited by examiner

OBLIQUE FASTENING APPARATUS

CROSS REFERENCE TO RELATED APPLICATION

This application claims priority of Taiwanese Application No. 104107260, filed on Mar. 6, 2015.

FIELD

The disclosure relates to an apparatus, more particularly to an oblique fastening apparatus.

BACKGROUND

Referring to FIG. 1, a fastener 101 is commonly fastened to a surface 100 of a workpiece in a perpendicular manner. Though it is a fast and easy way to fasten to the surface 100 of the workpiece, the surface 100 of the workpiece is formed with a hole and burrs that are obvious, so that the fastener 101 is unsuitable for use on the surface of a workpiece with higher quality.

To overcome the aforesaid drawback, a fastener installation tool 1, as disclosed in European Patent Publication No. EP2517834 and as shown in FIG. 2, is developed. The fastener installation tool 1 comprises a hollow frame body 11, two positioning mechanisms 12 respectively disposed at two opposite sides of the frame body 11, a handle 13 connected to the frame body 11, and a drive mechanism 14 for driving a left one of the positioning mechanisms 12 as viewed from FIG. 2. Each of the positioning mechanisms 12 includes a positioning block 121 that is movable relative to the frame body 11, a clamping arm 123 connected to and extending downward from the positioning block 121 for clamping and positioning a workpiece (A), and an angled guide passage 124 extending obliquely through the positioning block 121 and the clamping arm 123. The positioning block 121 is formed with a discharge hole 122 communicating with the angled guide passage 124. The drive mechanism 14 includes a spring 141, and a drive handle 142 pivoted to the frame body 11. The spring 141 has one end hooked to the frame body 11, and the other end movable along with the left positioning mechanism 12.

In practice, the drive handle 142 is operated to move in the direction of an arrow 15 so as to drive the positioning block 121 of the left positioning mechanism 12 to move in the direction of an arrow 16. Through cooperation of the clamping arms 123 of the positioning mechanisms 12 and the resilient restoring force of the spring 141, the workpiece (A) is clamped and positioned between the clamping arms 123. Thereafter, two fasteners (B) can be respectively inserted into the angled guide passages 124 and screwed to the workpiece (A).

From the aforesaid structure of the fastener installation tool 1, it is apparent that the fastener installation tool 1 cannot cooperate with a readily available clamping tool for driving, but has to depend only on the drive mechanism 14 which is a special tool. Therefore, the use thereof is limited. Furthermore, the discharge hole 122 is formed in the positioning block 121 of each positioning mechanism 12 such that the chips generated when each fastener (B) is driven into the workpiece (A) must pass through the clamping arm 123 and a portion of the positioning block 121 of a respective positioning mechanism 12 before the chips can be discharged via the corresponding discharge hole 122. As such, the distance moved by the chips is rather long, and the chips are prone to be stuck in the corresponding angled guide passage 124. Moreover, the strength and stability for clamping the workpiece (A) using the resilient restoring force of the spring 141 are insufficient, so that each fastener (B) is likely to deviate when driven into the workpiece (A). This results in bulging and splitting of the workpiece (A).

SUMMARY

Therefore, an object of this disclosure is to provide an oblique fastening apparatus that can alleviate at least one of the drawbacks of the prior arts.

According to this disclosure, an oblique fastening apparatus configured to be driven by a clamping tool for clamping and positioning a workpiece comprises a first clamping unit, a second clamping unit and a guide unit. The first clamping unit includes a first main body, a first guide member connected to the first main body, a first clamping member extending transversely from the first main body in a direction opposite to the first guide member, and a first oblique fastener passage that is inclined with respect to the first main body and that extends through the first guide member and the first clamping member. The first oblique fastener passage has a first discharge section located between the first guide member and the first clamping member and communicating with ambient atmosphere. The second clamping unit includes a second main body configured to be driven by the clamping tool to move relative to the first main body, and a second clamping member extending transversely from the second main body in a direction similar to that of the first clamping member. The first and second clamping members are configured to clamp the workpiece therebetween. The guide unit includes a first guide structure formed on one of the first and second main bodies, and a second guide structure formed on the other one of the first and second main bodies and cooperating with the first guide structure to guide relative movement of the first and second main bodies.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
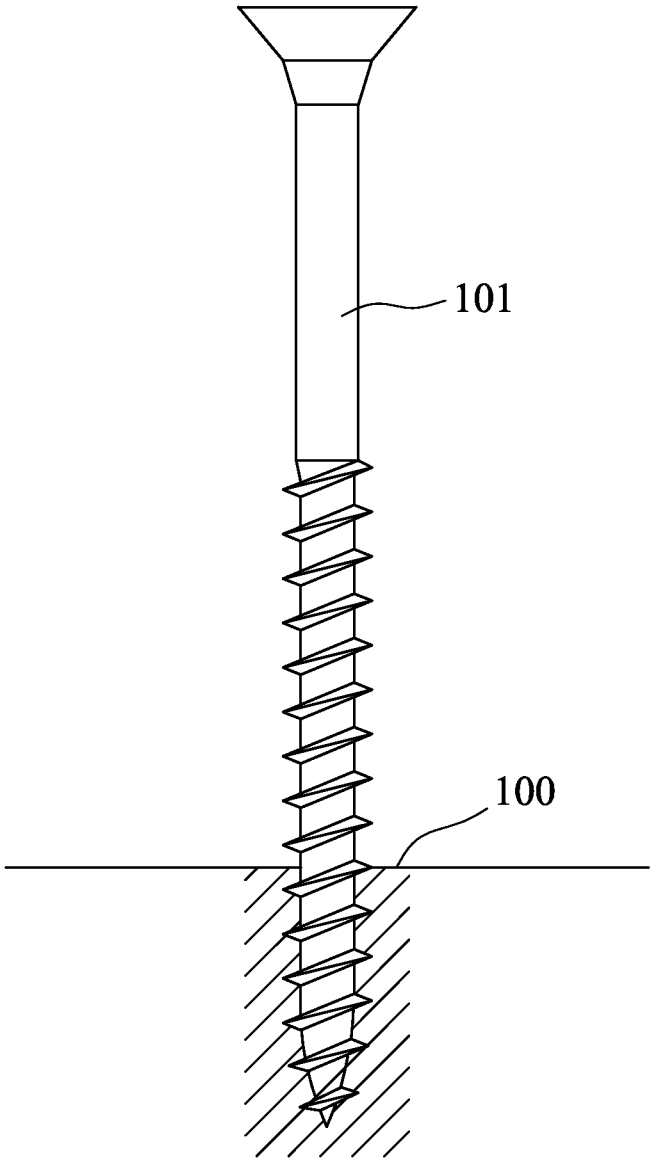
FIG.1 PRIOR ART
FIG. 1 is a schematic view for illustrating how a fastener is commonly fastened to a surface.

Before the present disclosure is described in greater detail with reference to the accompanying embodiments, it should be noted herein that like elements are denoted by the same reference numerals throughout the disclosure.

Figure 3:
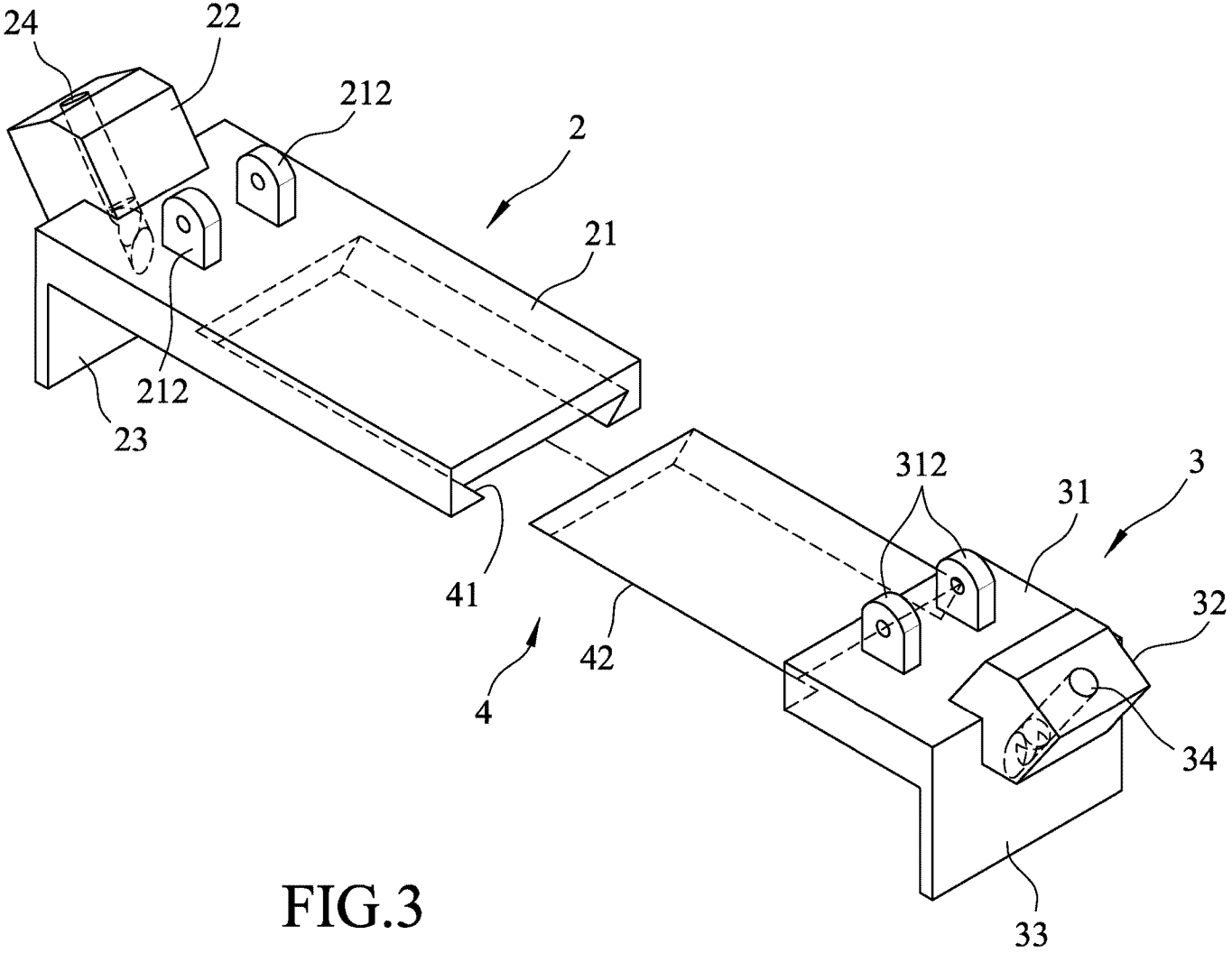
FIG. 3 is an exploded perspective view of the first embodiment of an oblique fastening apparatus according to the present disclosure.
Figure 4:
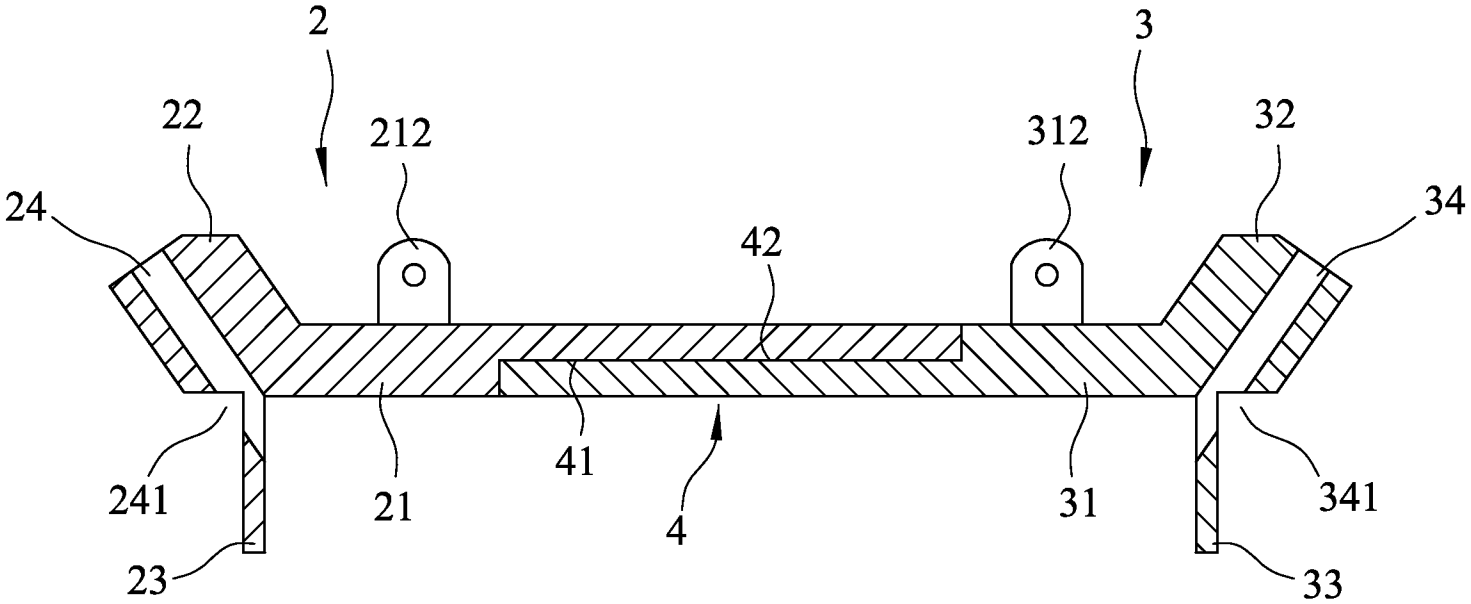
FIG. 4 is a sectional view of the first embodiment in an assembled state.

Referring to FIGS. 3 and 4, an oblique fastening apparatus according to the first embodiment of the disclosure is shown to have a generally elongate shape, and comprises a first clamping unit 2 and a second clamping unit 3 that are movable relative to each other, and a guide unit 4 to guide relative movement of the first and second clamping units 2, 3.

The first clamping unit 2 includes a first main body 21, a first guide member 22 connected to and protruding obliquely upward from the first main body 21, a plate-shaped first clamping member 23 extending downward from the first main body 21, and a first oblique fastener passage 24 that is inclined with respect to the first main body 21 and that extends through the first guide member 22 and the first clamping member 23.

The first clamping unit 2 further includes two spaced-apart first connecting members 212 protruding upward from the first main body 21. The first guide member 22 protrudes obliquely upward from a junction of the first main body 21 and the first clamping member 23. The first guide member 22 and the first connecting members 212 are located on the same side of the first main body 21. The first oblique fastener passage 24 has a first discharge section 241 located between the first guide member 22 and the first clamping member 23 and communicating with ambient atmosphere. In this embodiment, the first discharge section 241 is located at a junction of the first guide member 22 and the first clamping member 23.

The second clamping unit 3 includes a second main body 31 movable relative to the first main body 21, a second guide member 32 connected to and protruding obliquely upward from the second main body 31, a plate-shaped second clamping member 33 extending downward from the second main body 31, and a second oblique fastener passage 34 that is inclined with respect to the second main body 31 and that extends through the second guide member 32 and the second clamping member 33.

The second clamping unit 3 further includes two spaced-apart second connecting members 312 protruding upward from the second main body 31. The second guide member 32 protrudes obliquely upward from a junction of the second main body 31 and the second clamping member 33. The second guide member 32 and the second connecting members 312 are located on the same side of the second main body 31. The second oblique fastener passage 34 has a second discharge section 341 located between the second guide member 32 and the second clamping member 33 and communicating with the ambient atmosphere. In this embodiment, the second discharge section 341 is located at a junction of the second guide member 32 and the second clamping member 33, and the first and second clamping members 23, 33 have equal length.

The guide unit 4 includes a first guide structure 41 formed on the first main body 21, and a second guide structure 42 formed on the second main body 31 and corresponding in shape with and slidably engaged to the first guide structure 41.

Figure 5:
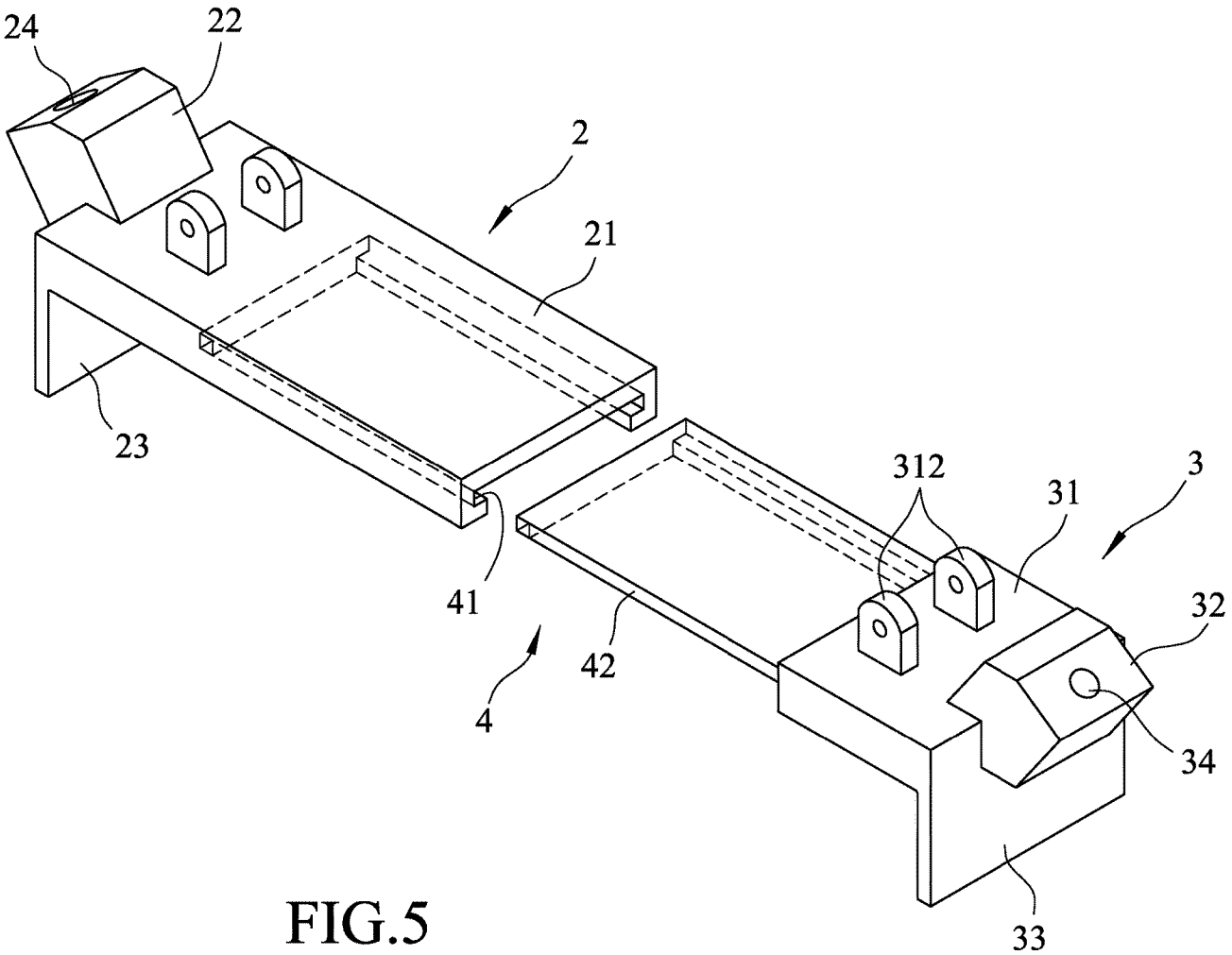
FIG. 5 is a view similar to FIG. 3, but illustrating a modified form of first and second guide structures of the first embodiment.
Figure 6:
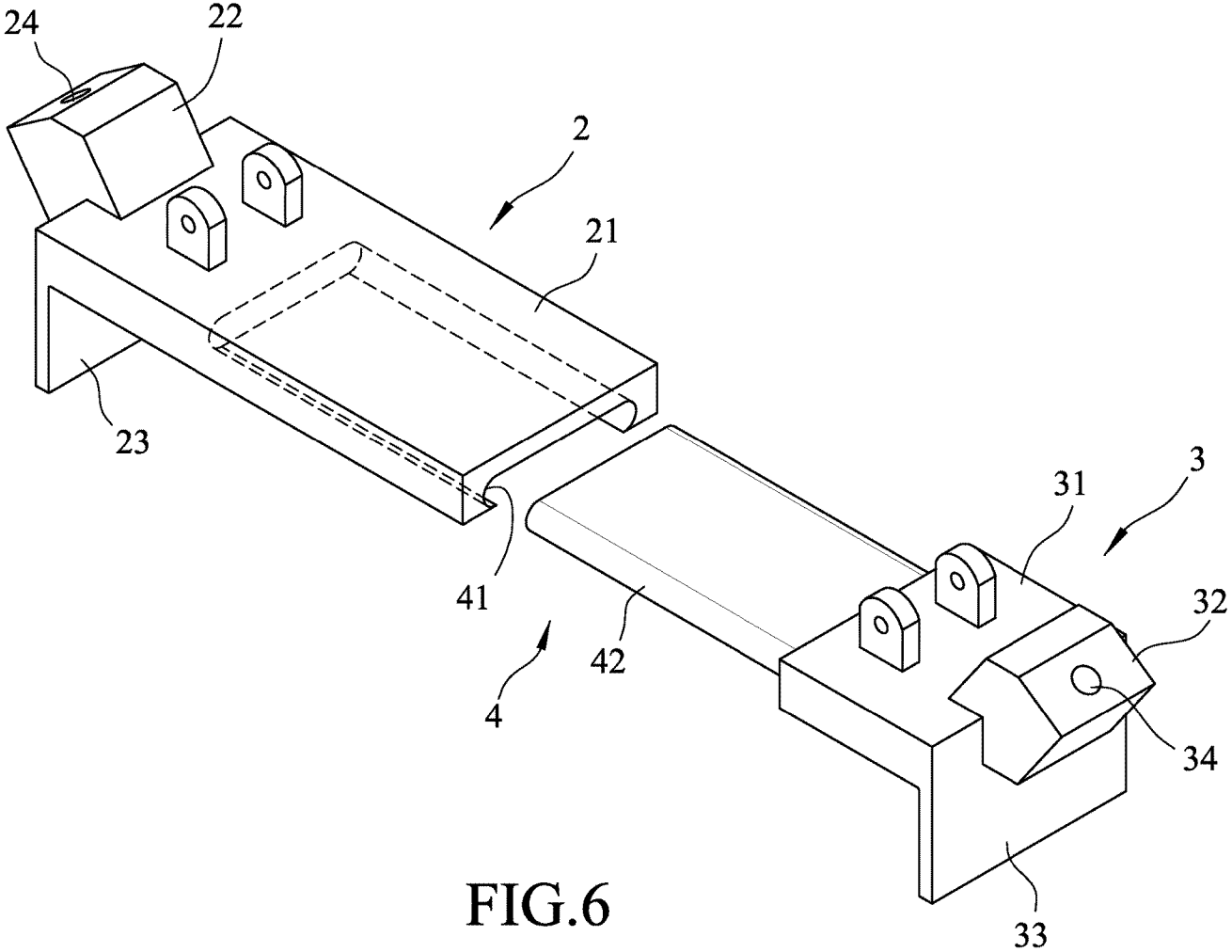
FIG. 6 is a view similar to FIG. 3, but illustrating another modified form of the first and second guide structures of the first embodiment.
Figure 7:
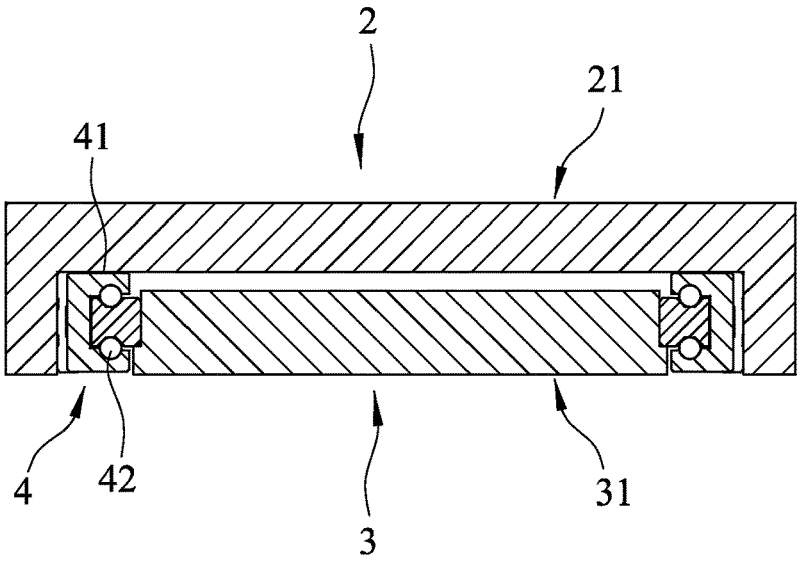
FIG. 7 is a sectional view, illustrating a third modified form of the first and second guide structures of the first embodiment.
Figure 8:
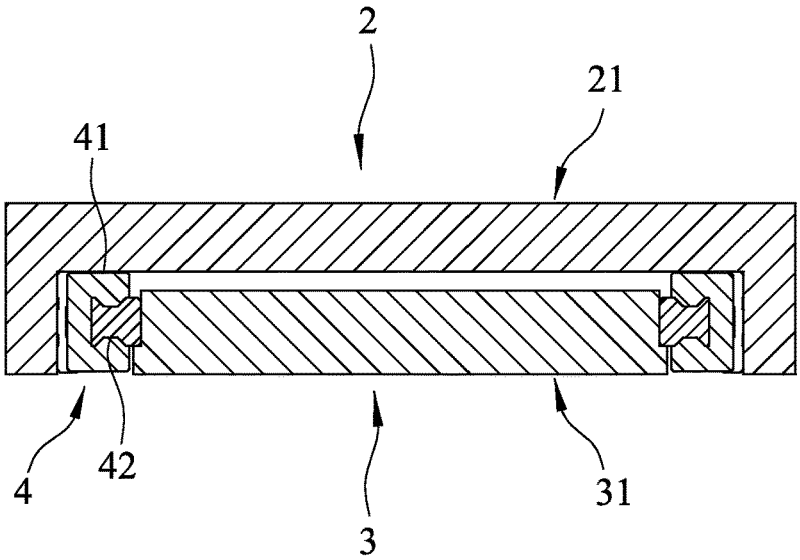
FIG. 8 is a sectional view, illustrating a fourth modified form of the first and second guide structures of the first embodiment.

In this embodiment, the first guide structure 41 is configured as a dovetail groove formed in the first main body 21, while the second guide structure 42 is configured as a dovetail tongue formed on the second main body 31 and slidably engaged in the dovetail groove. Alternatively, the first guide structure 41 may be configured as a T-shaped cross sectional groove, while the second guide structure 42 may be configured as a T-shaped cross sectional tongue slidably engaged in the T-shaped cross sectional groove, as shown in FIG. 5. Further, the first guide structure 41 may be configured as a substantially C-shaped cross sectional groove, while the second guide structure 42 may be configured as a C-shaped cross sectional tongue slidably engaged in the C-shaped cross sectional groove, as shown in FIG. 6. Moreover, the first and second guide structures 41, 42 may be configured as matching ball slide rail and ball slide member (see FIG. 7) or matching linearly slide rail and linearly slide member (see FIG. 8). These variations may achieve the same effect as that of the first embodiment.

Figure 9:
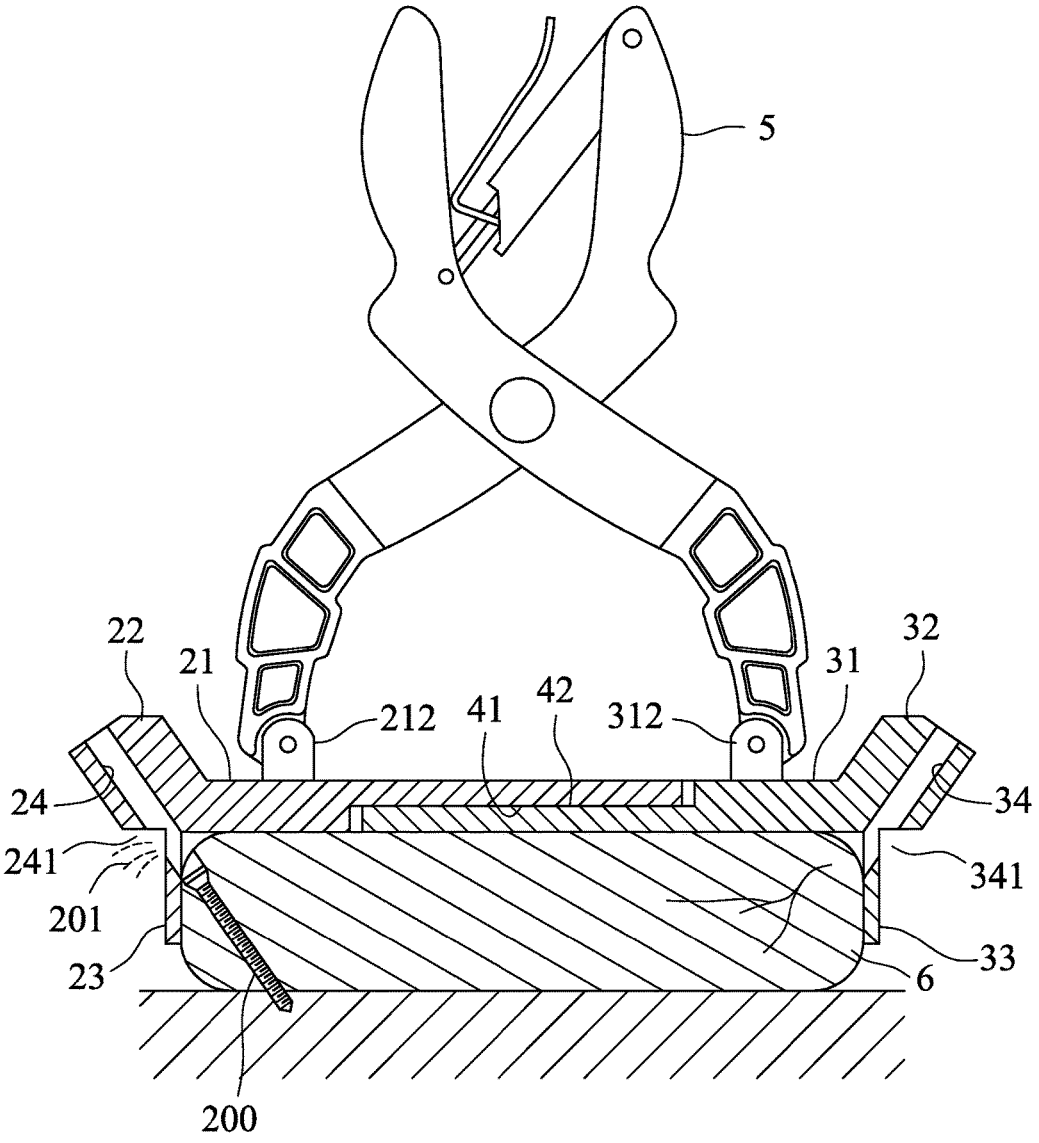
FIG. 9 illustrates how the first embodiment works in cooperation with a clamping tool.

Referring to FIG. 9, an existing clamping tool 5 is connected to the first and second connecting members 212, 312 to drive relative movement of the first and second main bodies 21, 31 according to the guidance of the first and second guide structures 41, 42, so that the first and second clamping members 23, 33 can cooperate with each other to clamp and position a workpiece 6 therebetween. At this moment, because of the configuration of the first and second guide members 22, 32, the first and second guide members 22, 32 cannot interfere with the clamping tool 5 during operation thereof. The clamping tool 5 exemplified in this embodiment is a pair of clamping pliers, as disclosed in Taiwanese Design Patent Number D155273, and the workpiece 6 is wood. However, the clamping tool 5 is not limited as such. As long as the clamping tool can be connected to the first and second connecting members 212, 312 to drive the relative movement of the first and second main bodies 21, 31, any kind of clamping tool that can achieve the same effect is acceptable.

The oblique fastening apparatus of the disclosure can indeed utilize the existing clamping tool 5 for operation. Apart from dispensing with the need for additional design of a special clamping tool, separate purchase can be made on the oblique fastening apparatus of the disclosure and the clamping tool 5, so that the oblique fastening apparatus of the disclosure is flexible to use.

It is worth to mention that, in this embodiment, each of the first and second connecting members 212, 312 is configured as a lug that protrudes from the corresponding first or second main body 21, 31. However, in an alternative embodiment, each of the first and second connecting members 212, 312 may be configured as an engaging groove formed in the corresponding first or second main body 21, 31. Hence, the configuration of the first and second connecting members 212, 312 is not limited to the aforesaid disclosure.

Figure 2:
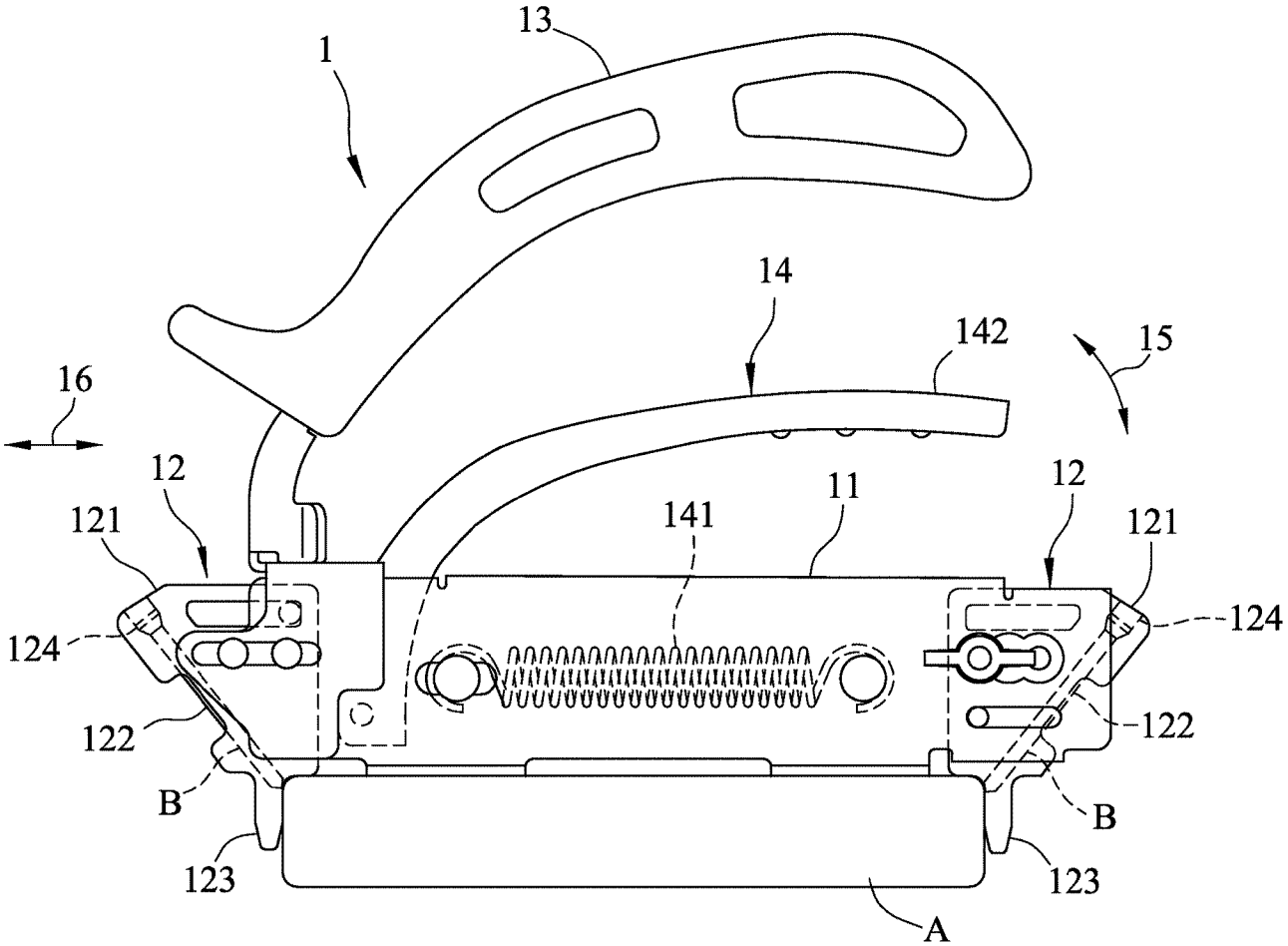
FIG.2 PRIOR ART
FIG. 2 is a schematic view of a fastener installation tool disclosed in European Patent Publication No. EP2517834.

After the first and second clamping members 23, 33 clamp and position the workpiece 6 therebetween, as shown in FIG. 9, a screw 200 can be inserted into the first or second oblique fastener passage 24, 34 so as to be fastened to the workpiece 6. Chips 201 generated during screwing of the screw 200 into the workpiece 6 is discharged through the first or second discharge section 241, 341. Because the first discharge section 241 is exposed to the ambient atmosphere and is located at the junction of the first guide member 22 and the first clamping member 23, and because the second discharge section 341 is exposed to the ambient atmosphere and is located at the junction of the second guide member 32 and the second clamping member 33, the distance moved by the chips 201 toward the first or second discharge section 241, 341 is shorter as compared to that in the conventional fastener installation tool 1 (see FIG. 2), so that the chips 201 can be prevented from being accumulated and stuck in the first or second oblique fastener passage 24, 34. Further, by using the first and second guide structures 41, 42 to guide the relative movement of the first and second main bodies 21, 31, the stability of the first and second clamping members 23, 33 in clamping the workpiece 6 therebetween can be enhanced. Moreover, the clamping force the first and second clamping members 23, 33 in clamping the workpiece 6 can also be enhanced through coordination with the clamping tool 5. Hence, the screw 200 can be fastened to the workpiece 6 and can be prevented from deviating from the set angle and oblique position, so that splitting and bulging of the workpiece 6 can also be prevented.

Figure 10:
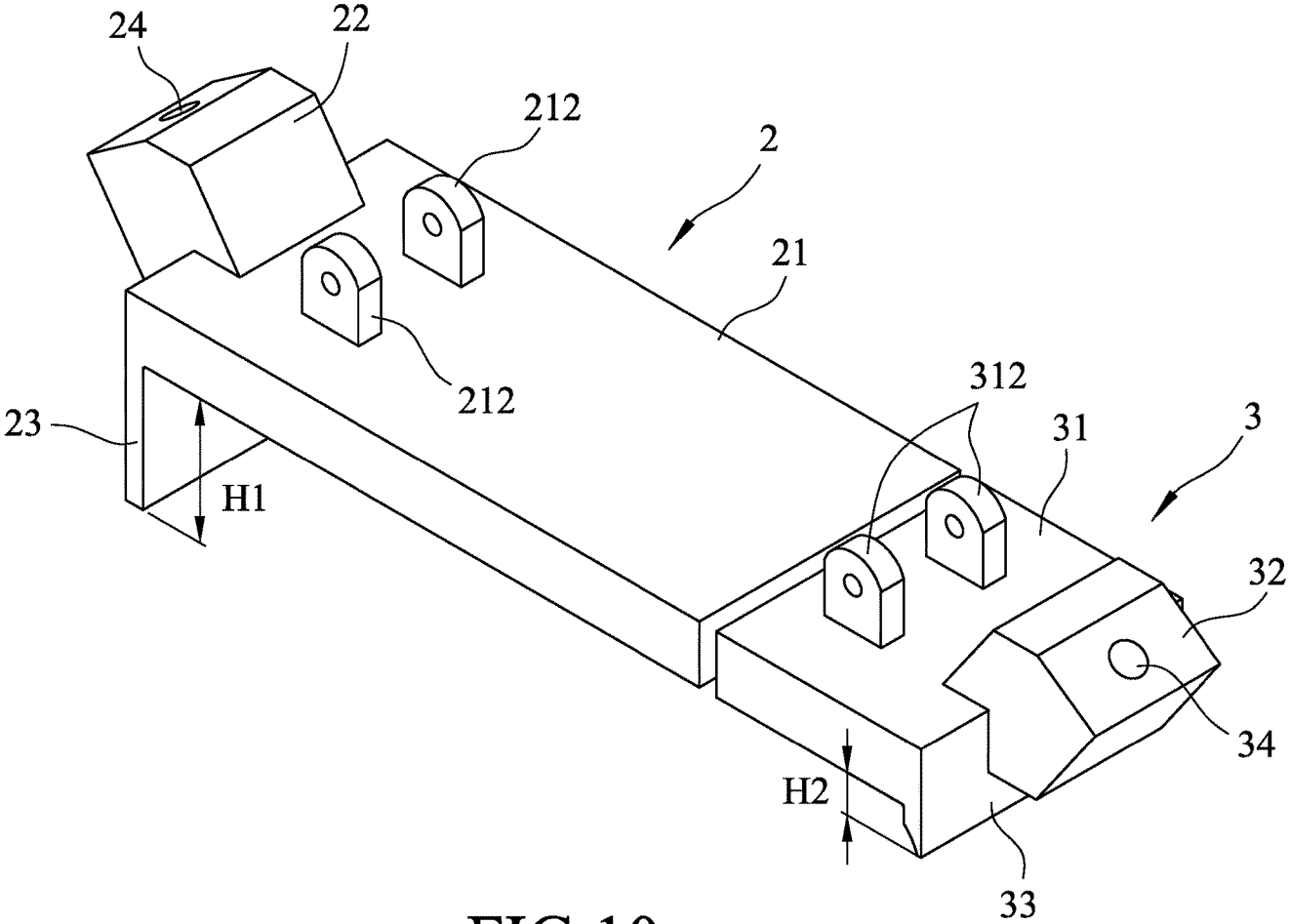
FIG. 10 is a perspective view of the second embodiment of an oblique fastening apparatus according to the present disclosure.
Figure 11:
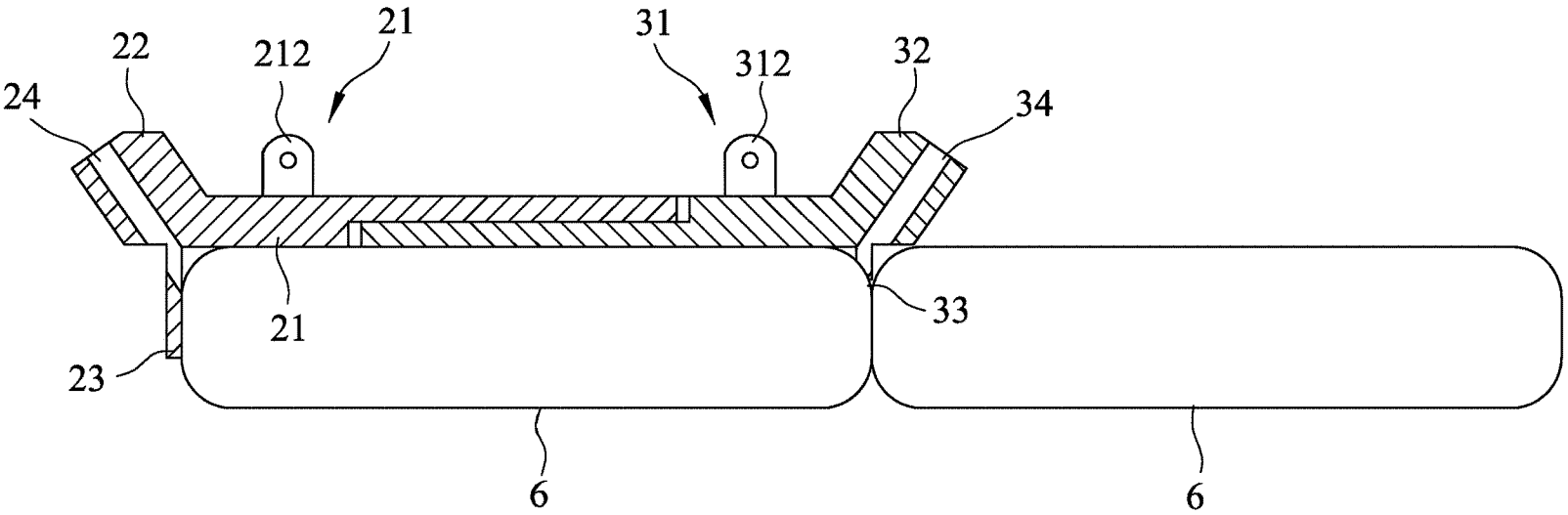
FIG. 11 is a sectional view of the second embodiment in a state of use.

Referring to FIGS. 10 and 11, the second embodiment of the oblique fastening apparatus according to this disclosure is shown to be generally identical to the first embodiment, and differs in that the height (H1) of the first clamping member 23 relative to the first main body 21 is greater than the height (H2) of the second clamping member 33 relative to the second main body 31.

As shown in FIG. 11, the second clamping member 33 is positioned between two workpieces 6 that abut against each other with no clearance therebetween, and cooperates with the first clamping member 23 to clamp and position therebetween one of the workpieces 6. Apart from achieving the same effect as that of the first embodiment, the second embodiment can also be used for two abutting workpieces 6. Hence, the scope of application of this embodiment is wider than that of the first embodiment.

Figure 12:
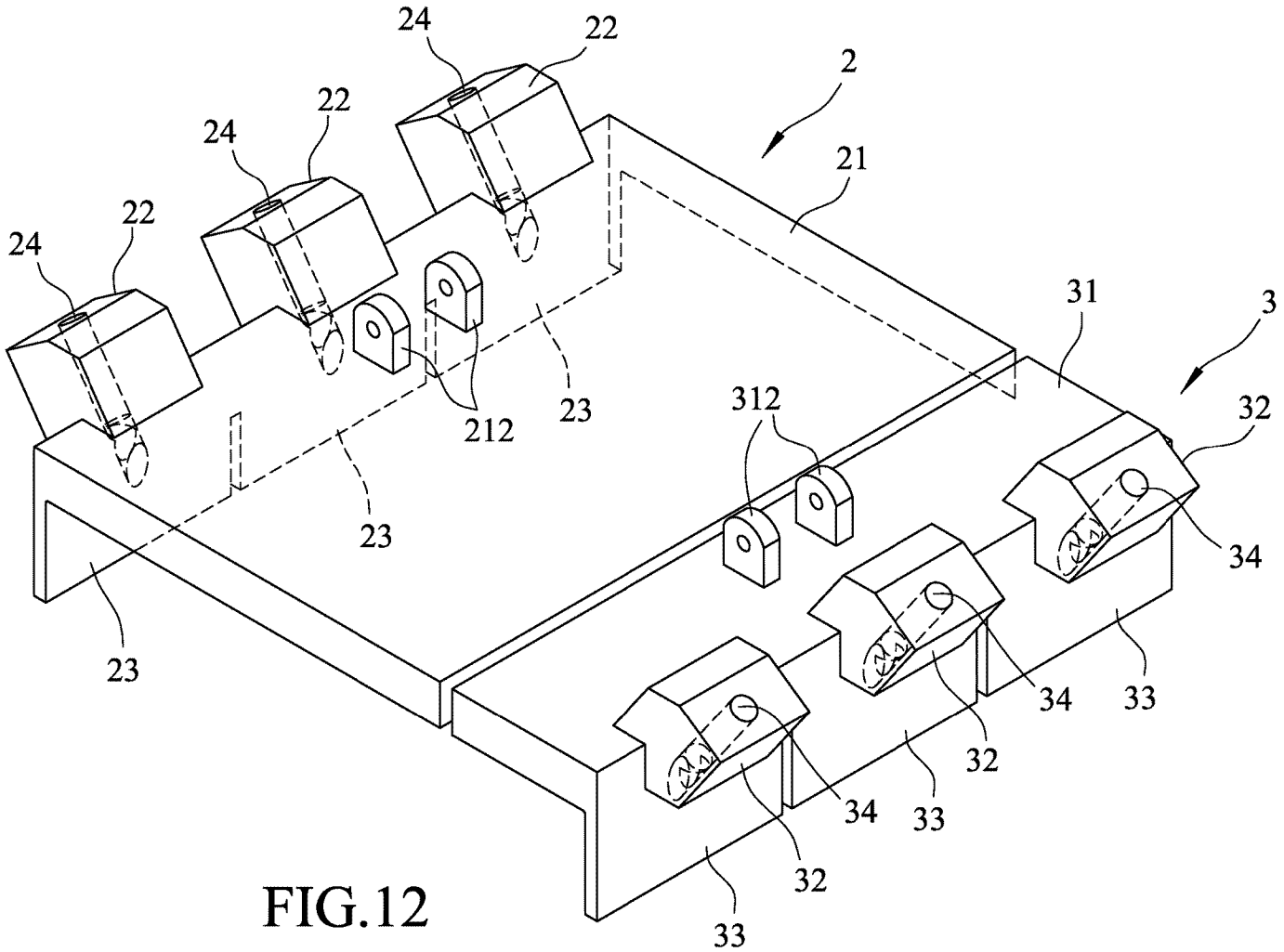
FIG. 12 is a perspective view of the third embodiment of an oblique fastening apparatus according to the present disclosure.

Referring to FIG. 12, the third embodiment of the oblique fastening apparatus according to this disclosure is shown to be generally identical to the first embodiment. However, in this embodiment, the first clamping unit 2 includes three first guide members 22 connected to and protruding obliquely upward from the first main body 21, three first clamping members 23 extending transversely from the first main body 21 in the direction opposite to the first guide members 22, and three first oblique fastener passages 24 each of which is inclined with respect to the first main body 21 and extends through one of the first guide members 22 and a corresponding one of the first clamping members 23. Further, the second clamping unit 3 includes three second guide members 32 connected to and protruding obliquely upward from the second main body 31, three second clamping members 33 extending transversely from the second main body 31 in the direction opposite to the second guide members 32, and three second oblique fastener passages 34 each of which is inclined with respect to the second main body 31 and extends through one of the second guide members 32 and a corresponding one of the second clamping members 33. Through the configuration of the first and second clamping units 2, 3 of this embodiment, apart from achieving the same effect as that of the first embodiment, the fastening operation of this embodiment can be performed on different locations with just a single clamping and positioning operation, so that the entire operating time can be effectively shortened and the efficiency of the fastening operation can be enhanced.

Figure 13:
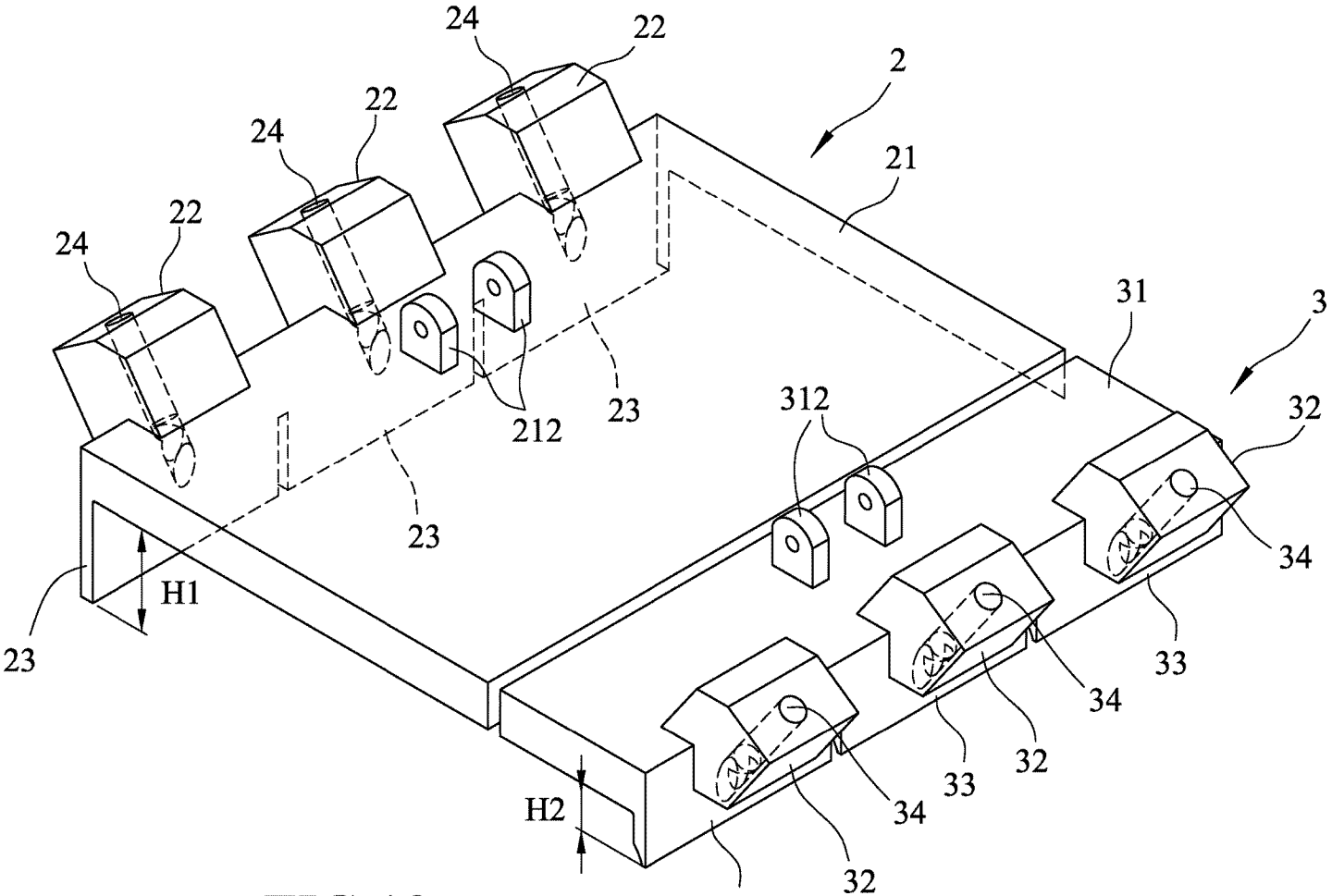
FIG. 13 is a perspective view of the fourth embodiment of an oblique fastening apparatus according to the present disclosure.

Referring to FIG. 13, the fourth embodiment of the oblique fastening apparatus according to this disclosure is shown to be generally identical to the third embodiment, and differs in that the height (H1) of each of the first clamping members 23 relative to the first main body 21 is greater than the height (H2) of each of the second clamping members 33 relative to the second main body 31. The advantages described in the second and third embodiments can be achieved using the fourth embodiment.

Figure 14:
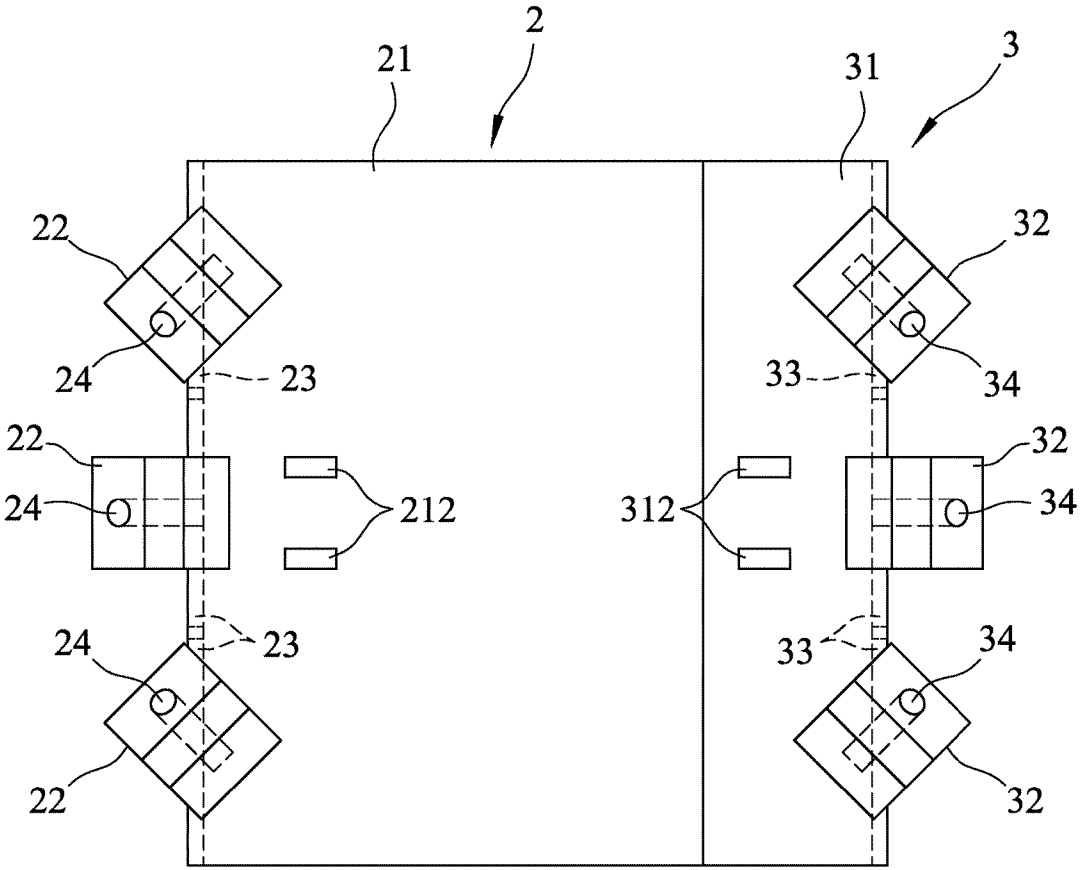
FIG. 14 is a schematic top view of the fifth embodiment of an oblique fastening apparatus according to the present disclosure.

Referring to FIG. 14, the fifth embodiment of the oblique fastening apparatus according to this disclosure is shown to be generally identical to the third embodiment, and differs in that the three first guide members 22 are not parallel to each other, and the three second guide members 32 are also not parallel to each other. That is, two of the first guide members 22 are inclined relative to a middle one of the first guide members 22 and are inclined in opposite directions relative to each other, and two of the second guide members 32 are inclined relative to a middle one of the second guide members 32 and are inclined in opposite directions relative to each other. Through the arrangement of the first and second guide members 22, 32, apart from achieving the same effect as that of the third embodiment, the fastening direction and variation of this embodiment can be increased, especially for fastening a workpiece that is proximate to a wall (see FIG. 9).

Figure 15:
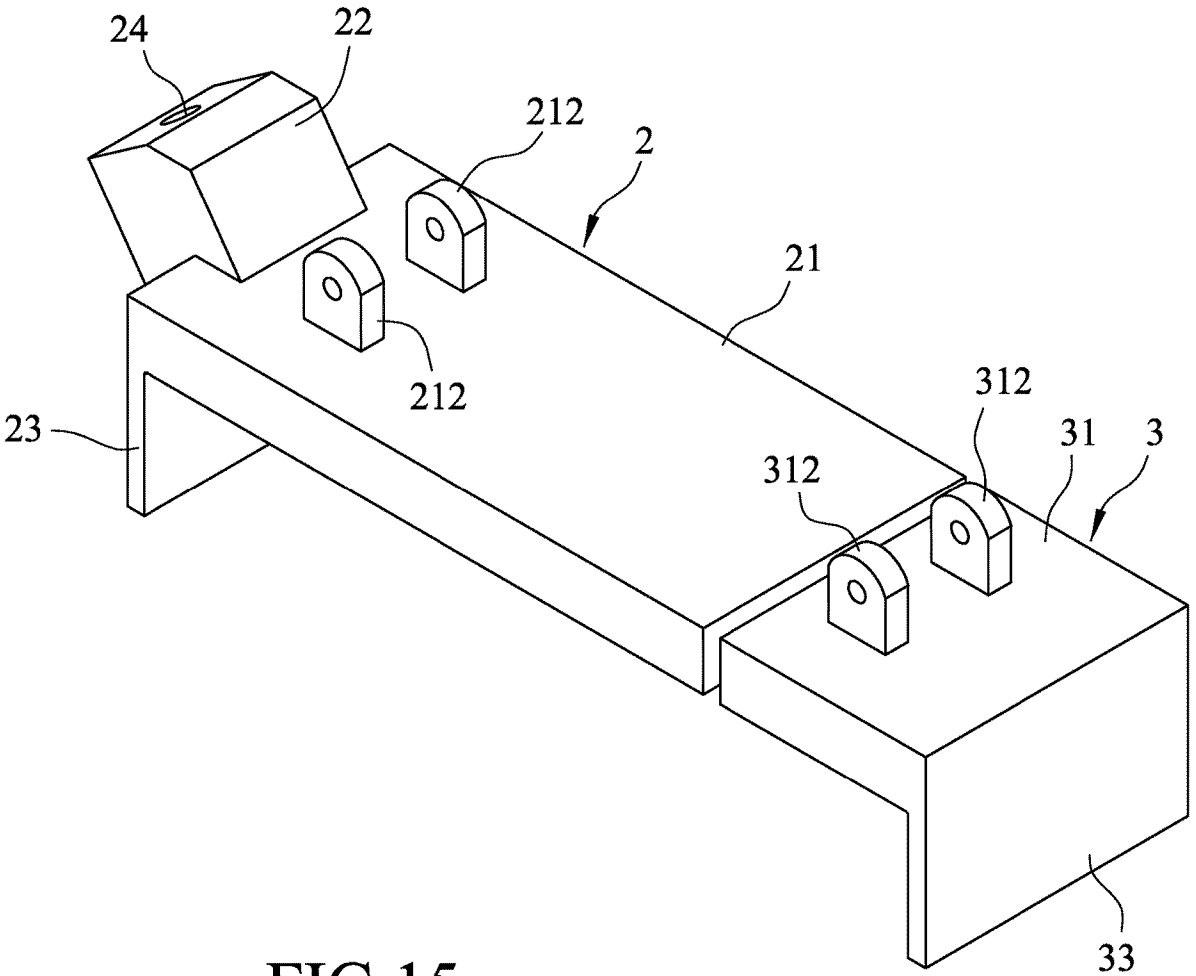
FIG. 15 is a perspective view of the sixth embodiment of an oblique fastening apparatus according to the present disclosure.

Referring to FIG. 15, the sixth embodiment of the oblique fastening apparatus according to this disclosure is shown to be generally identical to the first embodiment, and differs in that the second guide member 32 (see FIG. 3) and the second oblique fastener passage 34 (see FIG. 3) are omitted herein. Apart from achieving the same effect as that of the first embodiment, the manufacturing cost of this embodiment can be effectively reduced as well.

Figure 16:
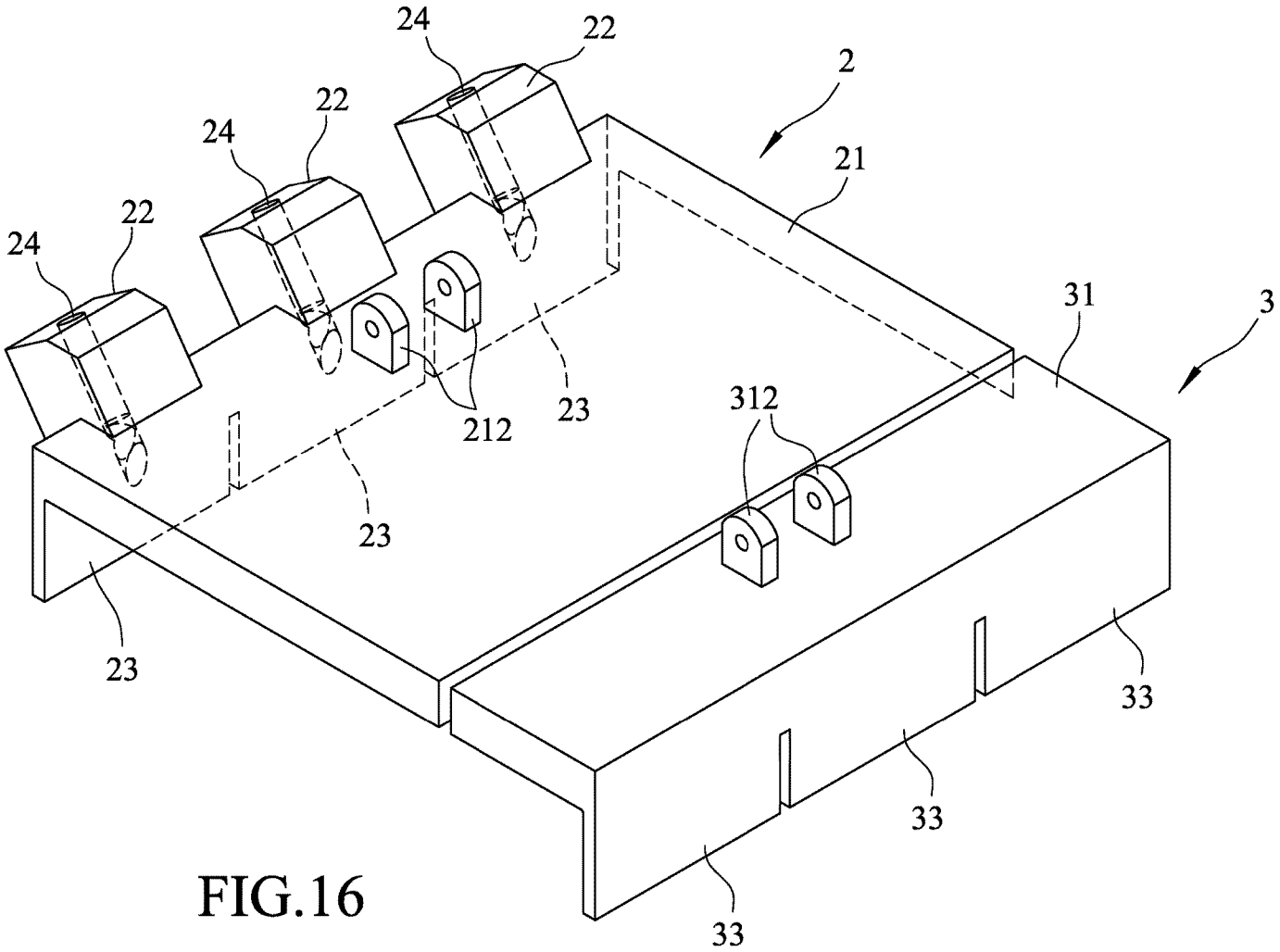
FIG. 16 is a perspective view of the seventh embodiment of an oblique fastening apparatus according to the present disclosure.

Referring to FIG. 16, the seventh embodiment of the oblique fastening apparatus according to this disclosure is shown to be generally identical to the third embodiment, and differs in that the second guide members 32 (see FIG. 12) and the second oblique fastener passages 34 (see FIG. 12) are omitted herein. Apart from achieving the same effect as that of the third embodiment, the manufacturing cost of this embodiment can be effectively reduced as well.

While the disclosure has been described in connection with what are considered the most practical embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An oblique fastening apparatus that is operable with a clamping tool for clamping and positioning a workpiece, said oblique fastening apparatus comprising:

a first clamping unit including a first main body having two opposite ends, a first guide member connected to one of said, two opposite ends of said first main body, a first clamping member extending transversely from said one end of said first main body in a direction opposite to said first guide member, and a first oblique fastener passage that is inclined with respect to said first main body and that extends through said first guide member and said first clamping member, said first oblique fastener passage having a first discharge section located between said first guide member and said first clamping member and communicating with ambient atmosphere;

a second clamping unit including a second main body that has two opposite ends and that is configured to be driven by the clamping tool to move relative to said first main body, and a second clamping member extending transversely from one of said two opposite ends of said second main body in a direction similar to that of said first clamping member, said first and second clamping members being configured to clamp the workpiece therebetween; and a guide unit including a first guide structure formed as a groove in said first main body, and a second guide structure formed as a tongue on said second main body, said tongue extending into said groove from the other one of said two opposite ends of said first main body to slide in said groove and to guide relative movement of said first and second main bodies, said tongue and said groove being distally spaced from said one ends of said first and second main bodies.

2. The oblique fastening apparatus as claimed in claim 1, wherein said first clamping unit further includes a first connecting member protruding from said first main body, and said second clamping unit further includes a second connecting member protruding from said second main body, said first and second connecting members being configured to connect with the clamping tool.

3. The oblique fastening apparatus as claimed in claim 2, wherein said second clamping unit further includes a second guide member connected to said one end of said second main body, and a second oblique fastener passage that is inclined with respect to said second main body and that extends through said second guide member and said second clamping member, said second oblique fastener passage having a second discharge section located between said second guide member and said second clamping member and communicating with the ambient atmosphere.

4. The oblique fastening apparatus as claimed in claim 1, wherein said groove of said first guide structure is configured as a dovetail groove forming in said first main body, and said tongue of said second guide structure is configured as a dovetail tongue formed on said second main body and slidably engaged in said dovetail groove.

5. The oblique fastening apparatus as claimed in claim 1, wherein said groove of said first guide structure is configured as a linear slide rail formed in said first main body, and said tongue of said second guide structure is configured as a linear slide member formed on said second main body and slidably engaged with said linear slide rail.

6. The oblique fastening apparatus as claimed in claim 1, wherein said groove of said first guide structure is configured as a ball slide rail formed in said first main body, and said tongue of said second guide structure is configured as a ball slide member formed on said second main body and slidably engaged with said ball slide rail.

7. The oblique fastening apparatus as claimed in claim 1, wherein said groove of said first guide structure is configured as a substantially C-shaped cross sectional groove formed in said first main body, and said tongue of said second guide structure is configured as a C-shaped cross sectional tongue formed on said second main body and slidably engaged in said C-shaped cross sectional groove.

8. The oblique fastening apparatus as claimed in claim 1, wherein said groove of said first guide structure is configured as a T-shaped cross sectional groove formed in said first main body, and said tongue of said second guide structure is configured as a T-shaped cross sectional tongue formed in said second main body and slidably engaged in said T-shaped cross sectional groove.

9. The oblique fastening apparatus as claimed in claim 1, wherein the height of said first clamping member relative to said first main body is greater than that of said second clamping member relative to said second main body.

10. The oblique fastening apparatus as claimed in claim 1, wherein:

said first clamping unit includes a plurality of said first guide members connected to said first main body, a plurality of said first clamping members extending transversely from said first main body in a direction opposite to said first guide members, and a plurality of said first oblique fastener passages each of which is inclined with respect to said first main body and extends through one of said first guide members and a corresponding one of said first clamping members, each of said first oblique fastener passages having said first chip-discharge section that is located between said one of said first guide members and the corresponding one of said first clamping members and that communicates with the ambient atmosphere; and said second clamping unit includes a plurality of said second clamping members extending transversely from said second main body in the direction similar to that of said first clamping members.

11. The oblique fastening apparatus as claimed in claim 10, wherein said second clamping unit further includes a plurality of second guide members connected to said second main body, and a plurality of second oblique fastener passages each of which is inclined with respect to said second main body and extends through one of said second guide members and a corresponding one of said second clamping members, each of said second oblique fastener passage having said second chip-discharge section that is located between said one of said second guide members and the corresponding one of said second clamping members and that communicates with the ambient atmosphere.

12. The oblique fastening apparatus as claimed in claim 11, wherein said first oblique fastener passages are not parallel with each other, and said second oblique fastener passages are not parallel with each other.

13. The oblique fastening apparatus as claimed in claim 10, wherein the height of each of said first clamping members relative to said first main body is greater than that of each of said second clamping members relative to said second main body.

14. An oblique fastening apparatus that can be used with a clamping tool for clamping and positioning a workpiece, said oblique fastening apparatus comprising:

a first clamping unit including a first main body having two opposite ends, a first guide member connected to one of said two opposite ends of said first main body, a first clamping member extending transversely from said one end of said first main body in a direction opposite to said first guide member, and a first oblique fastener passage that is inclined with respect to said first main body and that extends through said first guide member and said first clamping member;

a second clamping unit including a second main body that has two opposite ends and that is configured to be driven by the clamping tool to move relative to said first main body, and a second clamping member extending transversely from one of said two opposite ends of said second main body in a direction similar to that of said first clamping member, said first and second clamping members being configured to clamp the workpiece therebetween; and a guide unit including a first guide structure formed as a groove in said first main body, and a second guide structure formed as a tongue on said second main body, said tongue extending into said groove from the other one of said two opposite ends of said first main body to slide in said groove and to guide relative movement of said first and second main bodies, said tongue and said groove being distally spaced from said one ends of said first and second main bodies.

* * * * *